324-77
1/5/88 XR 4,718,097 SR

United States Patent [19]
Uenoyama

[11] Patent Number: 4,718,097
[45] Date of Patent: Jan. 5, 1988

[54] METHOD AND APPARATUS FOR DETERMINING THE ENDPOINTS OF A SPEECH UTTERANCE

[75] Inventor: Tadashi Uenoyama, Tokyo, Japan

[73] Assignee: NEC Corporation, Tokyo, Japan

[21] Appl. No.: 620,742

[22] Filed: Jun. 14, 1984

[30] Foreign Application Priority Data

Jun. 22, 1983 [JP] Japan ..... 58-112036

[51] Int. Cl.[4] ..... G10L 5/00
[52] U.S. Cl. ..... 381/46; 324/77 E
[58] Field of Search ..... 381/41-50; 324/77 E

[56] References Cited

U.S. PATENT DOCUMENTS 2,237,899 4/1941 Bjornson ..... 381/46
3,394,309 7/1968 Dushek ..... 381/41
4,297,533 10/1981 Gander et al. ..... 381/46

*Primary Examiner*—Emanuel S. Kemeny
*Attorney, Agent, or Firm*—Schwartz, Jeffery, Schwaab, Mack, Blumenthal & Evans

[57] ABSTRACT

A speech utterance is supplied to a control circuit which includes a plurality of band-pass filters and a maximum value detector coupled to the filters. The maximum value of the outputs of the filters are fed to an endpoints-detector wherein the endpoints are located or determined using the maximum value and at least one threshold value.

3 Claims, 12 Drawing Figures 24
30
TO 14 (FIG. 1)
FROM
22(1)
22(2)
22(3)
22(4)
22(N-3)
22(N-2)
22(N-1)
22(N)
COMPARATOR AND ANALOG SWITCH UNIT

IN
IN
OUT
40
42

METHOD AND APPARATUS FOR DETERMINING THE ENDPOINTS OF A SPEECH UTTERANCE

BACKGROUND OF THE INVENTION

1. Field of the Invention

The present invention relates to a method and an apparatus for determining the endpoints of a speech utterance, and more specifically to such a method and an apparatus which feature an accurate detection of the beginning and end of an input speech signal especially with a low signal-to-noise ratio.

2. Description of the Prior Art

An important problem in speech processing is to detect the presence of speech in a background of noise. This problem is often referred to as the endpoint location problem. By accurately detecting the beginning and end of an utterance, the amount of processing of speech data can be kept to a minimum.

A known approach to locating the endpoints of a speech utterance is to compare a whole power (or a proportional value of the whole power) of an input speech signal with a threshold level. The beginning is determined when the whole power of the input speech signal exceeds the threshold. On the other hand, when the whole power falls below the threshold for more than a predetermined time interval, the time point at which the whole power intersects the threshold is deemed as the end point. This prior art however, has encountered a problem that if white noise is superimposed on the input speech signal, accurate detections of the endpoints are not expected due to the decreased signal-to-noise ratio. This prior art is described in "IEEE Transactions on Acoustics, Speech, and signal processing, Vol., ASSP-22, No. 5, October 1974" entitled "A Parametrically Controlled Spectral Analysis System for Speech", and also in "The Bell System Technical Journal, Vol. 54, No. 2, February 1975" entitled "An Algorithm for Determining the Endpoints of Isolated Utterances".

SUMMARY OF THE INVENTION

The object of the present invention is therefore to provide a method and an apparatus for determining the endpoints of a speech utterance, which is free from the aforementioned problem inherent in the prior art.

The another object of the present invention is to provide a method and an apparatus for determining the endpoints of a speech signal with a low signal-to-noise ratio due to the presence of white noise.

In brief these objects are fullfilled by supplying a speech utterance to a control circuit which includes a plurality of band-pass filters and a maximum value detector coupled to the filters, and feeding the maximum value of the outputs of the filters to an endpoints-detector wherein the endpoints are located or determined using the maximum value and at least one threshold value.

More specifically, a first aspect of the present invention takes a form of a method for determining the endpoints of a speech signal, comprising the steps of: (a) frequency dividing the speech signal and deriving the signal magnitude of each of predetermined frequency ranges; (b) selecting the maximum value of the signal magnitudes; and (c) determining the endpoints of the speech signal using the maximum value and at least one threshold level.

A second aspect of the present invention takes a form of an apparatus for determining the endpoints of a speech utterance, comprising: first means adapted to receive the speech utterance, the first means including a plurality of band-pass filters and a maximum value detector coupled to the plurality of band-pass filters, the maximum value detector being adapted to detect the maximum value of the outputs of the plurality of band-pass filters; and second means arranged to receive the maximum value for determining the endpoints using the maximum value and at least one predetermined threshold level.

BRIEF DESCRIPTION OF THE DRAWINGS

The features and advantages of the present invention will become more clearly appreciated from the following description taken in conjunction with the accompanying drawings in which like blocks, circuits or circuit elements are denoted by like reference numerals and in which.

DETAILED DESCRIPTION OF THE PREFERRED EMBODIMENTS

Figure 1:
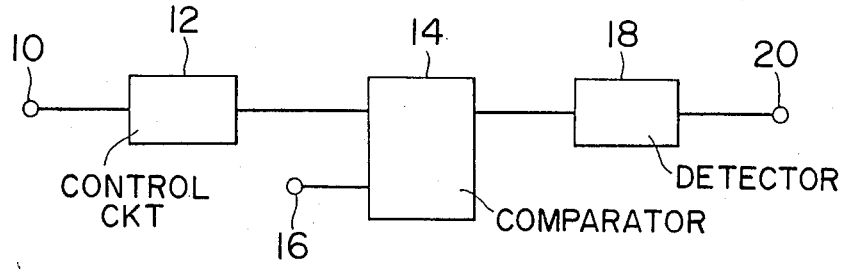
FIG. 1 shows in block diagram form an apparatus to which the present invention is directed.

Referring now to FIG. 1, there is shown in block diagram form an appartus for determining the endpoints of a speech signal, to which the present invention is applicable. In FIG. 1, a speech signal from a microphone (for example) is applied via input terminal 10 to a control circuit 12. The control circuit 12 in this embodiment comprises a plurality of band-pass filters (analog or digital) to which the input speech signal is applied, and which provides filtered output signals and a maximum value detector coupled to the outputs of the band-pass filters for generating a maximum envelope speech signal corresponding to a maximum amplitude envelope output from among the filtered output signals. The control circuit 12 is directly concerned with the present invention and hence will be discussed later with reference to FIG. 2 control circuit 12 outputs a maximum value of the outputs of the band-pass filters. The maximum value from the control circuit 12 is applied to a comparator 14 which compares same with a threshold value applied via terminal 16 and provides a threshold maximum envelope speech signal. The outputs of the comparator 14 is fed to a detector 18 wherein the endpoints of the input speech signal are detected. The output of the detector 18 is derived from output terminal 20.

Figure 2:
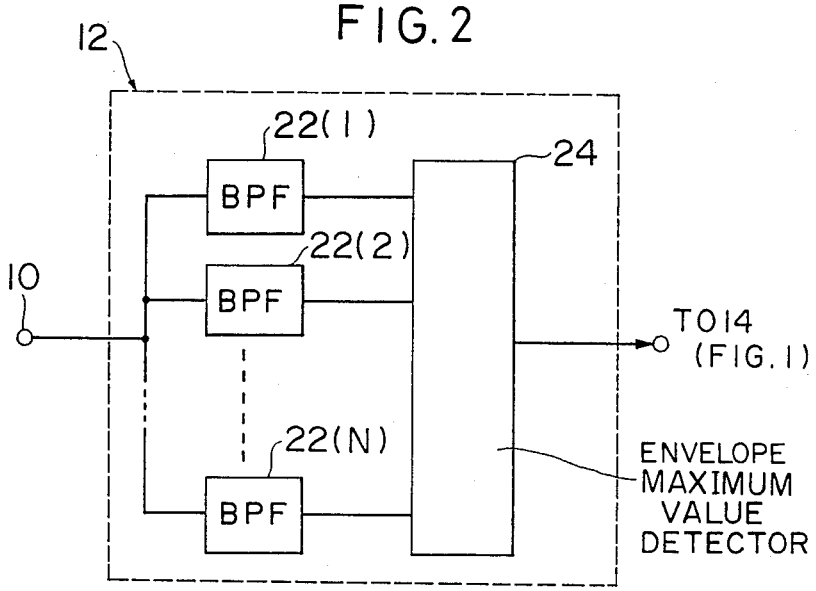
FIG. 2 is a block diagram showing a control circuit of the FIG. 1 arrangement.

Reference is now made to FIG. 2, wherein there is shown in block diagram form, a circuit configuration of the control circuit 12 which in this instance is of the analog type. The circuit 12 shown in FIG. 2 comprises a plurality of band-pass filter (BPF) 22(1) through 22(N) (wherein N is a whole positive integer), and a maximum value detector 24. The input speech signal is applied to the band-pass filters 22(1) through 22(N), the outputs of which are fed to the maximum value detector 24. The detector 24 selects the maximum value of the outputs of the band-pass filters and applies the maximum at predetermined time intervals to the next stage, viz., the comparatore 14 (FIG. 1).

Figure 3:
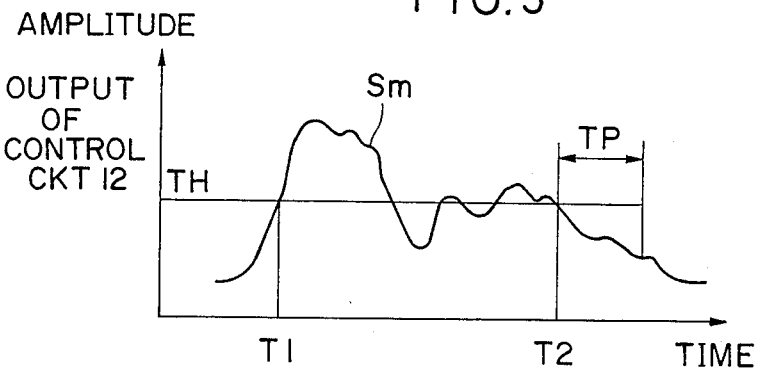
FIG. 3 is a graph showing the determination of the endpoints of an utterance.

FIG. 3 is a graph showing one example of the determination of the endpoints of the speech utterance using the output of the control circuit 12. As shown, the time point (T1) at which the output of the control circuit 12 (denoted Sm) exceeds a threshold value (denoted TH) is determined as the beginning point. In the case where the output Sm falls below the threshold TH for more than a predetermined time period TP, the time point T2 at which the output Sm intersects the threshold TH, is deemed as the end point of the utterance. It should be noted that the present invention is applicable to the case in which the output Sm is compared with two thresholds, for example.

Figure 4:
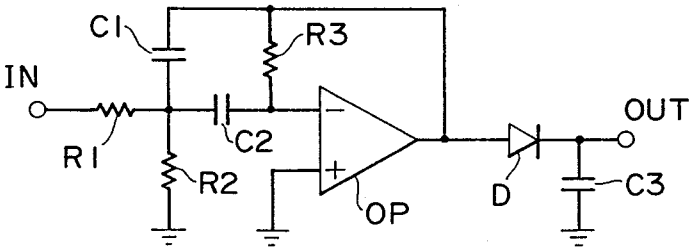
FIG. 4 is a conventional circuit configuration for use in the FIG. 2 circuit.

FIG. 4 shows a known circuit configurations which is usable as each of the band-pass filters 22(1) through 22(N) shown in FIG. 2. This circuit as shown, comprises resistors R1, R2 and R3, capacitors C1, C2 and C3, a diode D, and an operational amplifier OP, all of which are coupled as shown. The operation of the FIG. 4 circuit is well known to those skilled in the art, so that the description thereof will be omitted for clarity.

Figures 5, 6:
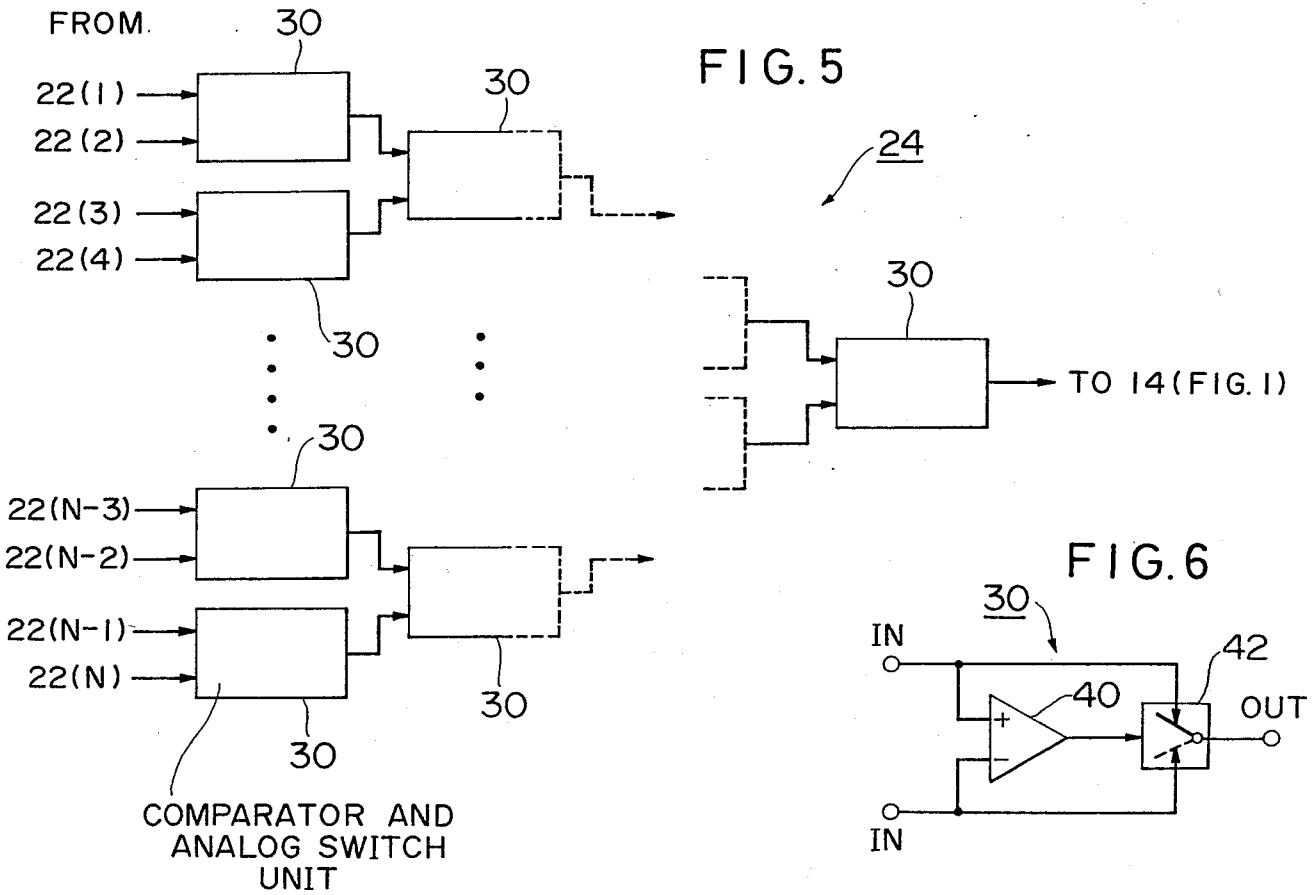
FIG. 5 is a block diagram showing a maximum value detector which may be used in the FIG. 2 circuit.
FIG. 6 is a block diagram showing one example of a comparator and analog switch unit utilized in the FIG. 5 arrangment.

FIG. 5 is a block diagram showing one example of the detector 24 (FIG. 2) including a plurality of blocks or units 30. Each of these units is identical in configuration. One example of same is shown in FIG. 6. The first row (vertical) or group of blocks 30 are arranged to be supplied with the outputs of the band-pass filters 22(1) through 22(N). Each block 30 functions to select the higher of the two band-pass filters inputs. The subsequent rows (vertical) or groups of blocks or units 30 each functions to select one of the two inputs thereto in a tournament-like manner until only one remains. As shown in FIG. 6, each block or unit 30 comprises a comparator 40 and an analog switch 42 which are arranged to receive two inputs. The comparator 40 applies the comparison result as a control signal to the analog switch 42. The switch 42 changes its switch position in response to the control signal applied so as to supply the next block with the higher input. The analog switch 42 may take the form of a component denoted μPD4053BC manufactured by NEC Corporation, for example.

The present invention is not limited to the above discussed analog type of circuits, and is also applicable to digital types without departing from the aforementioned principle which underlies the present invention.

Figure 7:
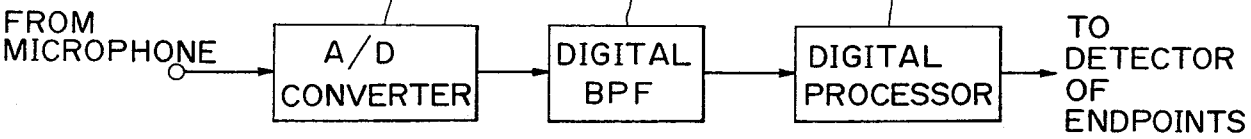
FIG. 7 is a block diagram showing an apparatus of the digital type for determining the endpoints of an utterance according to the present invention.

FIG. 7 shows in block diagram form an example of digital type of apparatus embodying the present invention. In FIG. 7, a speech signal (analog signal) is converted into digital signals at an analog-to-digital (A/D) converter 50, the output of which is applied to a digital band-pass filter (BPF) unit 52 comprising a plurality of band-pass filters (not shown). The blocks 50 and 52 correspond to the control circuit 12 (FIG. 1). The output of the digital BPF unit 52 is fed to a digital processor 54 which corresponds to the comparator 14 shown in FIG. 1. The A/D converter 50 and the digital BPF unit 52 are of conventional types, and may take the form of, for example, an A/D converter 11 and a band-pass filter section (no reference numeral), resepectively, disclosed in U.S. Pat. No. 4,157,457 issued June 5, 1979.

Figure 8:
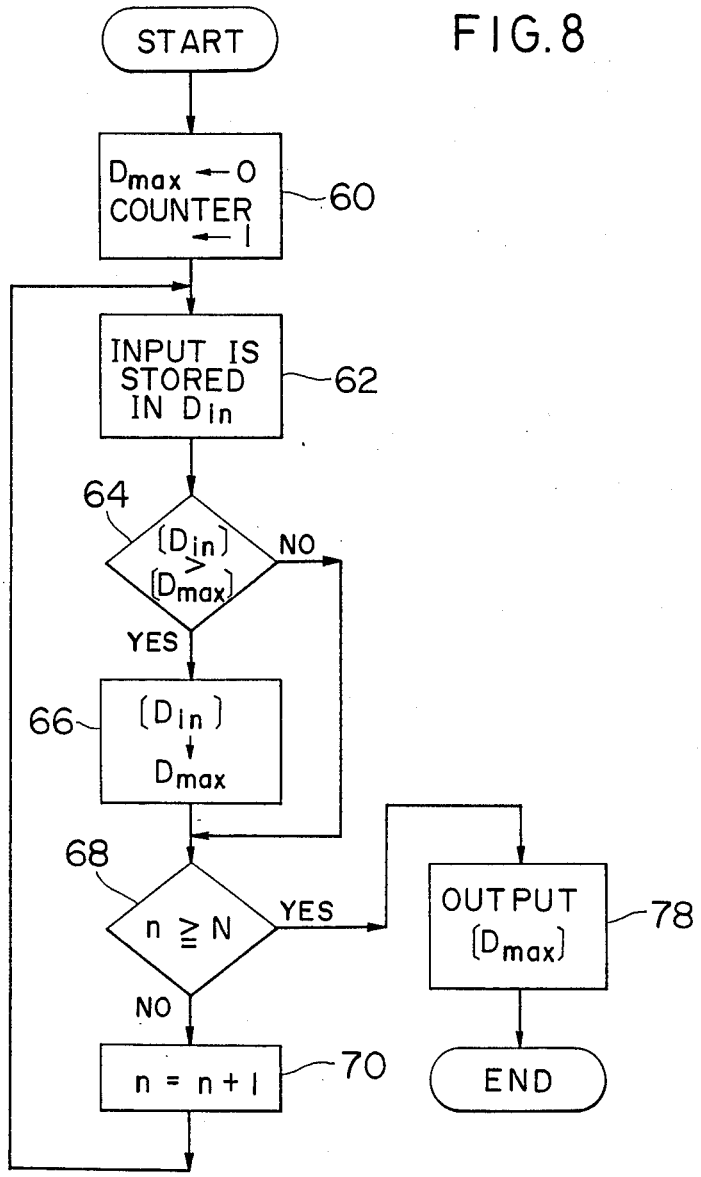
FIG. 8 is a flow chart showing the steps which characterize the operation of the arrangement shown in FIG. 7.

FIG. 8 is a flow chart showing the steps which characterize the program via which the maximum value of the outputs of the digital BPF unit 52 during each predetermined time duration, are determined. This determination is implemented in the digital processor 54. At step 60, the memory area (Dmax) for storing the maximum value is cleared, and the number 1 is set in a counter for counting up the number of input digital singals within the predetermined time duration. It is assumed that N (a positive integer) is the total number of the input digital signal applied to the digital processor 54 within one predetermined duration. At step 62, a first digital input is stored in a memory area (Din) and the number 1 is stored in the counter. At step 64, a check is performed to determine whether the content of Din is larger than that of Dmax (the contents are denoted by being parenthesized in the flow chart). If the result of this comparison is "YES", then the program goes to step 66 wherein [Din] is stored in the memory area Dmax, and thence goes to step 68. If the answer is "NO" at step 64, the program moves to step 68 where a comparison is implemented to ascertain whether "n" (the content of the counter) is larger than N. If "NO", the program goes to step 70 where "n+1" is stored in the counter and thence returns to step 62. These steps are repeated until "YES" is encoutered at step 68. If "YES", the program goes to step 78 where [Dmax] is derived.

Figure 9:
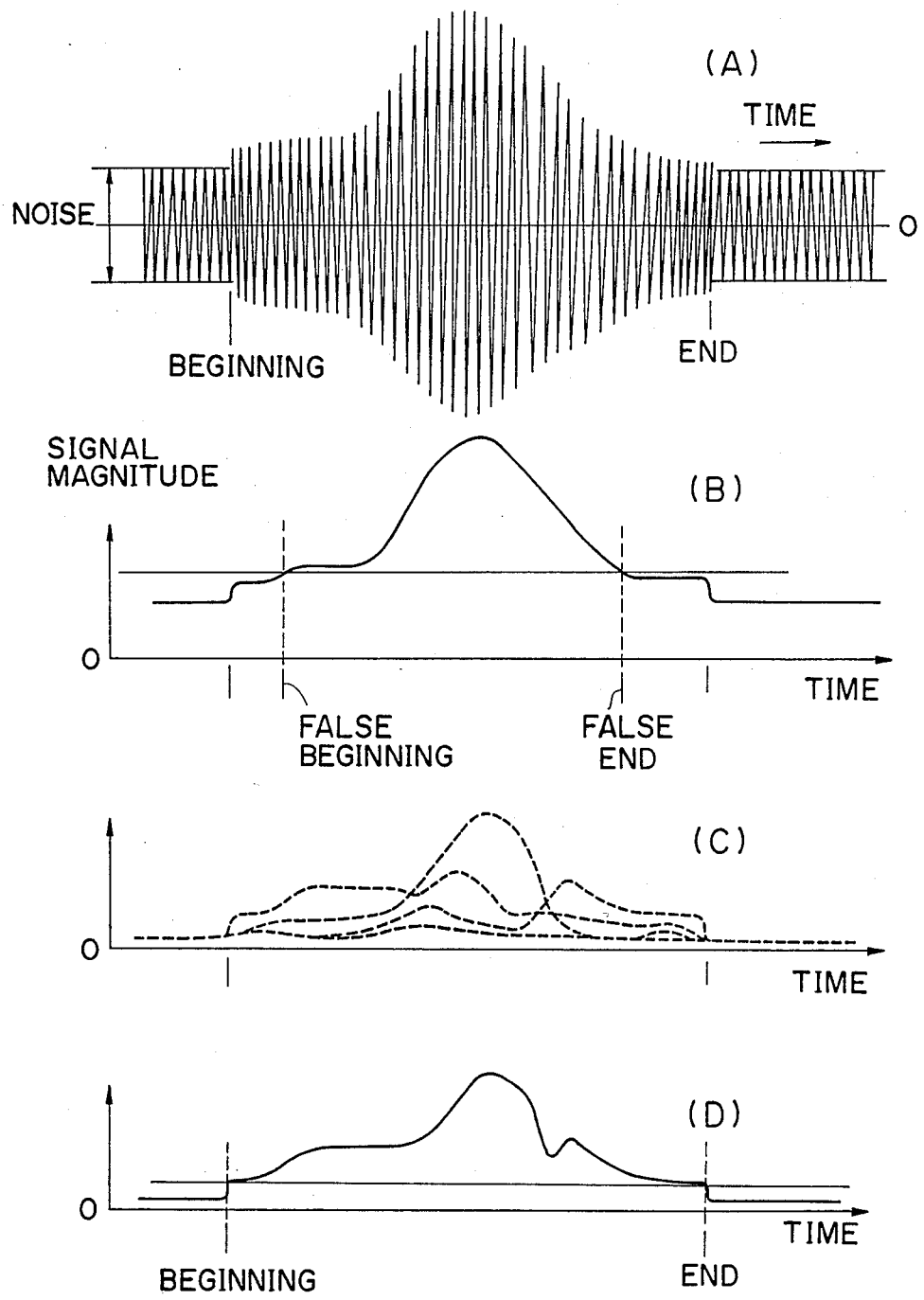
FIG. 9(A) through 9(D) are graphs which illustrate the advantage of the present invention over the prior art.

In order to further clarify the merit of the present invention, the latter will be compared with the prior art with reference to FIG. 9.

FIG. 9(A) is a graph showing an analog input of a speech utterance wherein (1) white noise (denoted NOISE) is superimposed on a speech signal and (2) the actual beginning and end of the utterance are depicted BEGINNING and END, respectively. With the prior art, the determination of the endpoints of the utterance is implemented using the whole power of the input singal. Consequently, the threshold level must be set relatively high in order to detect the endpoints in the presence of white noise. This high setting of the threshold level leads to the false detection of the endpoints in the case where the powers of the utterance in the vicinity of the endpoints are not sufficiently high relative to the noise, as in the manner shown in FIG. 9(B). On the other hand, such a problem is effectively avoided with the present invention. More specifically, FIG. 9(C) shows the outputs of band-pass filters although only four outputs are plotted for simplicity, and FIG. 9(D) shows the envelope of the maximum outputs shown in FIG. 9(C), i.e., a maximum envelope speech signal. As clearly seen from FIG. 9(D), according to the present invention, the threshold level is capable of being set to a considerably low value, so that the endpoints of the utterance can be precisely located.

The foregoing description shows only preferred embodiments of the present invention. Various modifications are apparent to those skilled in the art without departing from the scope of the present invention which is only limited by the appended claims.

What is claimed is:

1. Apparatus for determining endpoints of speech utterances in a speech signal comprising:

a plurality of band-pass filters, each band-pass filter receiving said speech signal and providing a filtered output signal;

maximum value detector means connected to receive the filtered output signal of each band-pass filter for generating a maximum envelope speech signal corresponding to a maximum amplitude envelope output from among the filtered output signals;

comparator means connected to receive said maximum envelope speech signal from said maximum value detector means and a reference signal corresponding to a threshold value of speech utterances for generating a threshold maximum envelope speech signal; and endpoint determining means connected to receive said threshold maximum envelope speech signal for determining said speech utterance endpoints.

2. Apparatus as recited in claim 1, wherein said endpoint determining means comprises means for determining when said threshold maximum envelope speech signal falls below said threshold value for a predetermined period of time.

3. Apparatus as recited in claim 1, wherein said maximum value detector means and said comparator means are implemented in a programmed digital processor.

* * * * *